United States Patent [19]

Svensson

[11] Patent Number: 5,014,472

[45] Date of Patent: May 14, 1991

[54] TOMBSTONE

[76] Inventor: Sten Svensson, Trädgårdsgatan 4, S-912 00 Vilhelmina, Sweden

[21] Appl. No.: 469,710

[22] PCT Filed: Mar. 4, 1986

[86] PCT No.: PCT/SE87/00105

§ 371 Date: Oct. 28, 1987

§ 102(e) Date: Oct. 28, 1987

[87] PCT Pub. No.: WO87/05354

PCT Pub. Date: Sep. 11, 1987

Related U.S. Application Data

[63] Continuation of Ser. No. 116,713, Oct. 28, 1987, abandoned.

[30] Foreign Application Priority Data

Mar. 6, 1986 [SE] Sweden ..... 8601041

[51] Int. Cl.[5] ..... E04H 13/00

[52] U.S. Cl. ..... 52/103; 40/459; 40/541; 40/611

[58] Field of Search ..... 52/103, 104, 105; 40/124.5, 459, 541, 611

[56] References Cited

U.S. PATENT DOCUMENTS

| | | | |
|---|---|---|---|
| 158,866 | 1/1875 | Richardson | 52/103 |
| 215,457 | 5/1879 | Jackson | 52/103 |
| 475,002 | 5/1892 | Treat | 52/104 |
| 1,298,182 | 3/1919 | De Witt | 52/103 |
| 1,585,411 | 5/1926 | Patterson | 52/103 |
| 1,982,432 | 11/1934 | Hull | 52/103 |
| 2,120,082 | 6/1938 | Anderson | 52/103 |
| 2,188,419 | 1/1940 | Saviteer | 52/103 |
| 2,255,277 | 9/1941 | Bronson | 52/103 |
| 2,525,091 | 10/1950 | Brownawell | 52/103 |
| 3,481,089 | 12/1969 | Sheidow | 52/103 |

FOREIGN PATENT DOCUMENTS

| | | | |
|---|---|---|---|
| 2317313 | 10/1974 | Fed. Rep. of Germany | 52/104 |
| 3121949 | 5/1985 | Fed. Rep. of Germany . | |
| 217790 | 11/1941 | Switzerland . | |
| 2052590 | 1/1981 | United Kingdom | 52/103 |

*Primary Examiner*—Henry E. Raduazo
*Assistant Examiner*—Deborah McGann Ripley
*Attorney, Agent, or Firm*—Cushman, Darby & Cushman

[57] ABSTRACT

A tombstone intended to be anchored upright in or on a foundation includes an inscription plate (13) attached as front side in a casing (1) and a foot (7) connected to the casing (1). It is intended to achieve a tombstone having a long life and a low weight. It will be possible to provide the tombstone with an inscription even after it has been erected. It can also be used as a storage space.

5 Claims, 2 Drawing Sheets

TOMBSTONE

This is a continuation of application No. 07/116,713, filed Oct. 28, 1987, which was abandoned upon the filing hereof.

BACKGROUND OF THE INVENTION

This invention relates to a tombstone of the type intended to be anchored upright in or on a foundation.

Tombstones are found in different forms and materials, usually stone or wood. Tombstones made of a wooden material have a limited life but, on the other hand, they are easy to handle thanks to their relatively low weight. Tombstones made of a stone material are heavy and consequently awkward to handle, not the least in connection with their erection but, on the other hand, have a substantially longer life than tombstones of a wooden material. Due to their weight, tombstones of stone materials also require a well prepared and a more stable foundation than wooden tombstones to be able maintain their intended position for a long time. Moreover, tombstones of a wooden material have the advantage in comparison with tombstones of a stone material that it is easier to make the intended inscription in wood than in stone.

SUMMARY OF THE INVENTION

It is apparent from the above that the ideal of tombstones should be one so constituted that it combines the best qualities of tombstones of wood and stone materials, but not the negative qualities thereof. It is the object of this invention to provide such a tombstone, i.e. one having a long life, a low weight and which can be provided with the intended inscription without great difficulties even after being erected. It is also an object to provide a tombstone which can be so constituted that, if desired, it can be used as a repository for e.g. one or more flower-vases, small garden tools and the like.

BRIEF DESCRIPTION OF THE DRAWINGS

The invention is described in the following in greater detail with reference to the enclosed drawings in which.

DETAILED DESCRIPTION

Figure 1:
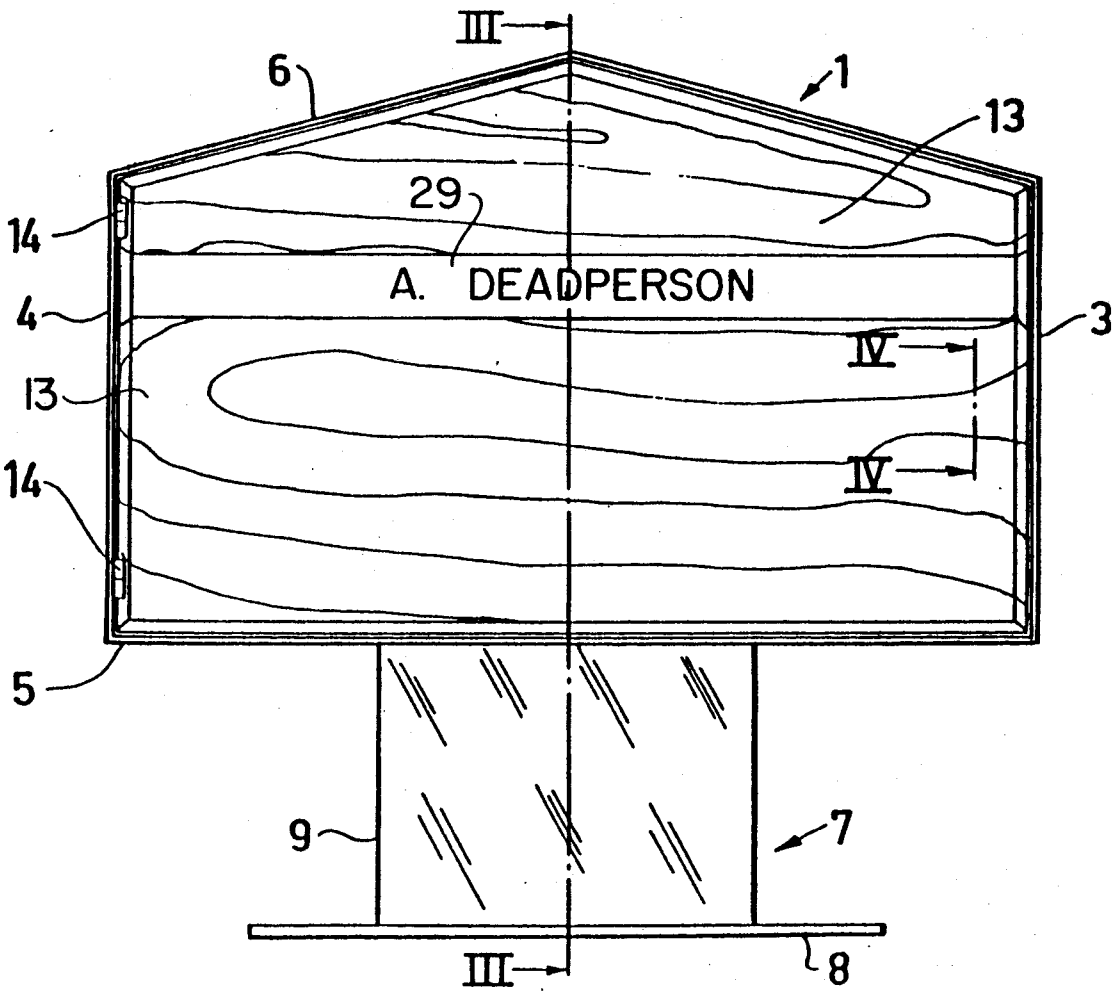
FIG. 1 is a front view of an embodiment of the tombstone.

The tombstone comprises a casing 1 made of a weatherproof material, for instance stainless steel, aluminum, a plastic material or the like which casing may have any desired form. A preferred form is shown as an example in FIG. 1. The casing 1 comprises a back side 2, two end sides 3, 4, a bottom 5 and a roof 6, having the form of a mansard roof in the example shown in FIG. 1. The sides included in the casing 1 are interconnected to constitute one unit, but it is also possible to form the casing 1 in one piece, for instance in case of plastic materials.

Figure 3:
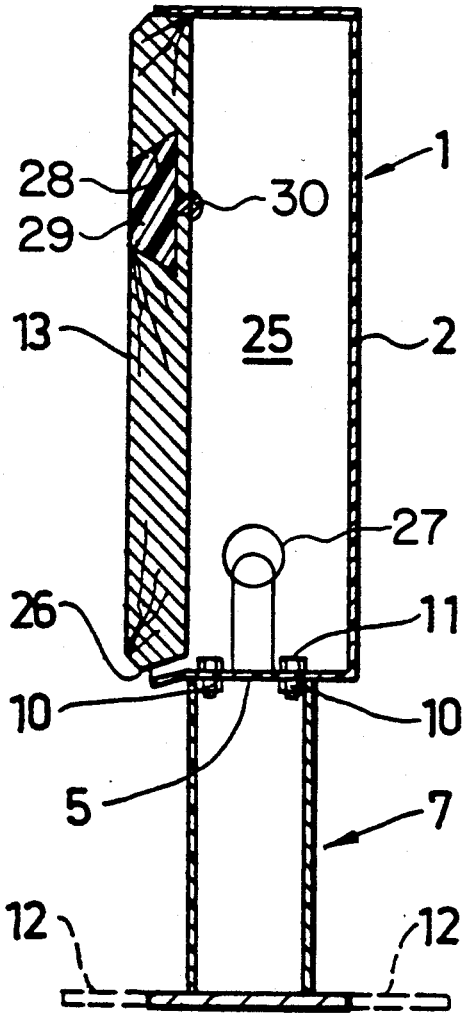
FIG. 3 shows a section taken along the line II—II in FIG. 1.

In addition to the casing 1, the tombstone comprises a foot 7 consisting of a foot plate 8 and a hollow stand 9 fixedly connected to the foot plate, preferably tightly, and having a rectangular cross-sectional form, in the example shown on the drawings. Of course, the stand may have another cross-sectional form suitable for the purpose. Mounting nuts 10 are fixedly arranged in the upper four corners of the stand, by means of which, and suitable bolts 11, the casing 1 is connected to the foot 7, as shown in FIG. 3. The tombstone is anchored in or on a foundation with the foot 7 and is preferably dug into the ground to a suitable depth so that the ground surface is preferably closer to the bottom 5 of the casing than the bottom plate 8 of the foot when the tombstone is erected. To increase the stability and consequently, to reduce the risk of a tombstone anchored in the ground being inclined, the bottom plate 8 of the foot can be made bigger than what is shown or be provided with laterally extending projections, as indicated in FIG. 3 with broken lines 12, which projections can be of the same material as the foot 7 such, in turn, should preferably be made of the same material as the casing 1.

According to the present invention the front side of the casing consists of, a first inscription plate 13, i.e. a front wall plate, made of a suitable material, preferably a wooden material such as teak, oak, pine or the like, treated in a suitable way to be as weatherproof as possible. Of course, the inscription plate can be made of another material, e.g. a plastic material similar to marble or marble which, however, is less suitable due to its relatively high density.

Figure 2:
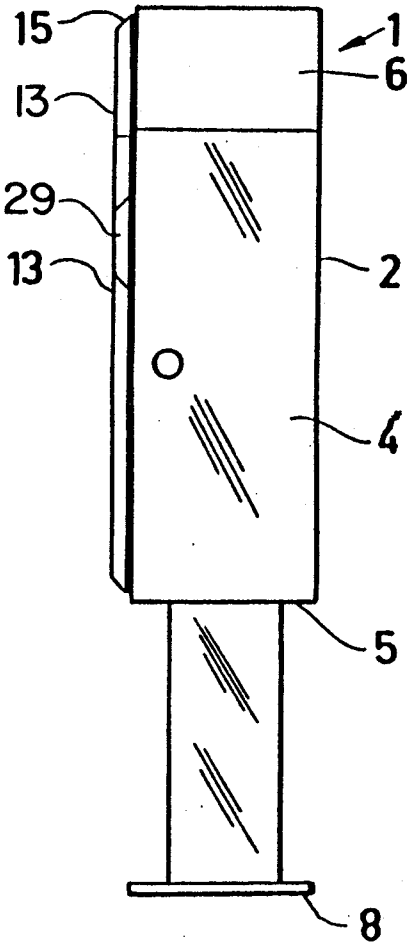
FIG. 2 is a lateral view thereof.

In the embodiment shown in the drawings, the inscription plate 13 is suspended in the casing 1 by means of hinges 14, which should be so arranged that the plate 13, in its closed position which is substantially parallel to the back side 2 where it preferably abuts with its edge portion turned from the hinges one or more supports arranged at the roof, end and/or bottom side 6, 3 and 5, respectively, of the casing, is substantially overlapped by the sides of the casing, as shown in FIG. 3. The part of the plate 13 lying outside the sides preferably has beveled corners, as shown at 15 in FIG. 2.

Figure 4:
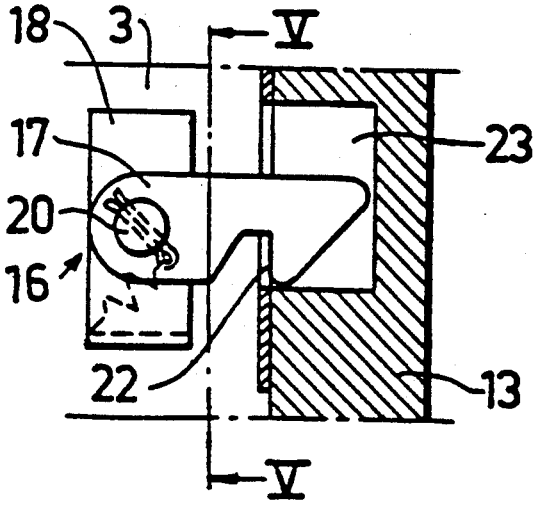
FIG. 4 shows a section taken substantially along the line IV—IV in FIG. 1
Figure 5:
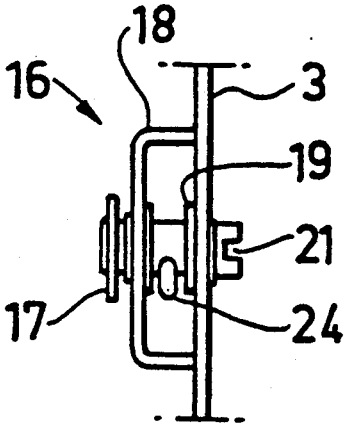
FIG. 5 shows a section taken along the line V—V in FIG. 4.

In its closed position, the plate 13 is locked by a locking means 16 of a type known per se. An example of such a locking means is shown in FIGS. 4 and 5, comprising a locking hook 17 attached to a locking shaft 20 mounted by means of bushings 19 in the end side 3 of the casing and in a clamp 18 attached to this. The shaft 20 has a key groove 21 in its portion outside the end side 3 of the casing for operating the locking hook into and out of locking position. In the locking position, the locking hook 17 engages behind a securing plate 22 attached to the back side of the plate. The plate 13 has a recess 23 for the locking hook 17 inside the securing plate 22. To prevent the locking shaft 20 from moving in its axial direction, a locking pin 24 is arranged between the bushings 19.

Thus, the casing forms, together with the inscription plate 13, a storage space 25 in which small garden tools, vases etc. can be stored and in which some type of lamp 27 also can be placed, preferably a battery-operated one for illuminating on suitable occasions the tombstone and the piece of ground in front of it. If the inscription plate is made of a light-permeable material, the bottom side 5 of the casing and the lower edge of the inscription plate facing said bottom side are so embodied that a slot 26 is formed between them through which light can beam and illuminate the burial-place in front of the tombstone. The inscription plate 13 should be as tightly connected to the sides 3, 4, 5 and 8 of the casing as possible along the other edges.

Due to the fact that the inscription plate 13 is removably arranged, it will be substantially simpler than in known tombstones to provide the tombstone with the intended inscription, especially after the tombstone is erected in position. In accordance with the invention, it is also possible to make one or more parallel, relatively wide grooves 28 of a dovetail-shaped cross-section in the first inscription plate 13 which grooves extend transversely of the plate 13 and in which a second inscription plates 29 with or without inscription, are arranged so that they can be made inserted or pulled out. These plates can be of the same material as the plate 13, or of another preferably contrasting material. This arrangement is particularly suitable with tombstones for family graves, as it is possible with these plates to provide the tombstone with the intended inscription in a very simple way. It should be noted that these grooves in the form of dovetails should have such a depth that the inscription plates cannot be removed when plate 13 is in a closed position but are prevented from this by the end sides 3, 4 of the casing, and these plates can also be locked in their grooves by means of screws 30 screwed from the back side of the plate.

Due to its unique design, the present tombstone includes many possibilities for variations in addition to those already mentioned. However, one such possibility is utilization of the foot of the tombstone as a water container due to its embodiment, in order to achieve long-term watering of flowers placed in front of the tombstone.

This invention is not restricted to what has been described above and shown on the drawings but can be changed and varied in several different manners within the scope of the claims.

I claim:

1. A tombstone, comprising:

a base;

a hollow, forwardly open sheet-metal casing mounted on said base and having a back wall, a roof wall, a bottom wall and two opposite side walls, said walls being joined to one another at respective edges and defining a chamber within said casing;

said base comprising a foot plate and an upright stand having a lower end secured to said foot plate and an upper end secured to said bottom wall of said casing, for supporting said casing above the ground;

an a first inscription plate formed of a material different from that of the casing, said inscription plate bearing an inscription relating to the decease of a being and constituting a front wall for the casing and being attached to said casing by hinge means which permit said front wall to be alternatively disposed in a closed position in which said inscription plate closes said chamber of the casing and an open position in which said chamber is accessible from externally of the tombstone;

a second inscription plate which is part of said first inscription plate, said second inscription plate bearing said inscription and being physically detachable from said first inscription plate when said front wall is in said open position; and means for unlockably locking of said first inscription plate in said closed position.

2. A tombstone, comprising:

a forwardly-open hollow casing including wall means providing left and right end walls, a roof, a bottom and a back, all joined to one another at respective edges, said left and right end walls, roof and bottom having front edges defining the perimeter of an opening to a chamber defined by said left and right end walls, roof and bottom;

a bottom plate adapted to be supported from the ground;

an upright stand having a lower end secured to said bottom plate and an upper end secured to said bottom of said casing, for supporting said casing above the ground;

a front wall plate having a front surface, a rear surface and an outer perimetrical edge;

at least one inscription plate for carrying data as to a deceased being, said inscription plate being displayed on said front surface of said front wall plate;

means at least partially detachably securing said front wall plate to said wall means of said casing, for manipulation to permit said inscription plate to be alternatively disposed in:

a closed position, in which said front surface of said inscription plate faces forwardly, said plate is at least partially recessed into said chamber so that said outer perimetrical edge of said plate is covered by said casing adjacent said front edges, about said perimeter of said opening, throughout at least a portion of the thicknesswise extent of said plate, and an open position in which said chamber is accessible from externally of the tombstone;

means for unlocking said front wall plate in said closed position;

means removably securing the inscription plate to said front wall plate, said removably securing means permitting removal of said inscription plate when said front wall plate is in said open position, but preventing removal of said inscription plate when said front wall plate is in said closed position;

said removably securing means comprise a dovetail joint between each inscription plate and said front wall plate permitting horizontal sliding of each said inscription plate into and out of mounted relationship to said front wall plate when said front wall plate is in said open condition;

each said inscription plate being sufficiently long, and said dovetail joint being sufficiently deep, in a front to rear sense, that engagement of each said inscription plate with said wall means at an end of the respective said dovetail joint prevents each said inscription plate from being slid out of mounted relation to said front wall plate when said front wall plate is disposed in said closed condition.

3. The tombstone of claim 2, wherein:

said removably securing means comprises screws installed through said front wall plate from said rear surface thereof, into said inscription plate.

4. The tombstone of claim 2, further including:

means defining a sufficiently open gap between said front wall plate and said front edge of said floor that a lit lamp, if disposed in said chamber, can shine out through the gap for illuminating the ground below and to the front of said tombstone.

5. The tombstone of claim 11, further including:

a lit lamp disposed in said chamber and shining out through said gap.

* * * * *